US006854995B2

(12) United States Patent
Hotea

(10) Patent No.: US 6,854,995 B2
(45) Date of Patent: Feb. 15, 2005

(54) CONNECTOR FOR DETACHABLY CONNECTING AN ELECTRICALLY CONDUCTIVE FOIL TO A CONTACT

(75) Inventor: Gheorghe Hotea, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/288,782

(22) Filed: Nov. 6, 2002

(65) Prior Publication Data

US 2003/0119353 A1 Jun. 26, 2003

(30) Foreign Application Priority Data

Nov. 7, 2001 (EP) ..... 01126347

(51) Int. Cl.[7] ..... H01R 13/15
(52) U.S. Cl. ..... 439/260; 439/495
(58) Field of Search ..... 439/495, 260, 439/261, 263, 493

(56) References Cited

U.S. PATENT DOCUMENTS 5,240,430 A * 8/1993 Soes ..... 439/260
5,622,505 A * 4/1997 Hashiguchi et al. ..... 439/67
5,735,709 A * 4/1998 Hashiguchi et al. ..... 439/495
5,928,029 A * 7/1999 Lam ..... 439/497
6,159,038 A * 12/2000 Wu ..... 439/495

FOREIGN PATENT DOCUMENTS

EP 0 926 778 A2 6/1999

* cited by examiner

*Primary Examiner*—Tho D. Ta
(74) *Attorney, Agent, or Firm*—Barley Snyder

(57) ABSTRACT

The invention relates to a connector (1) for detachably connecting an electrically conductive foil (10) to electrically conductive socket contacts (26) of a socket housing (3), wherein the foil (10) can be inserted into a contact receiving aperture (40) of the socket contact (26) and can be jammed therein.

Separation of connection and locking of the connector (1) is achieved in that, in addition to the socket housing (3), the connector comprises a foil housing (2) and the housings (2, 3) can be mutually connected, and in that prior to connection in a first foil slot (9) of the foil housing (2) and during connection via a second foil slot (11) of the socket housing (3), the foil (10) can be inserted without mating force into the open contact receiving aperture (40) of the socket contact (26), and in that the connector (1) can be locked and the foil (10) can be jammed by closing the contact receiving aperture (40) only after connection of the housings (2, 3).

16 Claims, 9 Drawing Sheets

CONNECTOR FOR DETACHABLY CONNECTING AN ELECTRICALLY CONDUCTIVE FOIL TO A CONTACT

FIELD OF THE INVENTION

The invention relates to an electrical connector for detachably connecting a foil to electrically conductive socket contacts of a socket housing

BACKGROUND OF THE INVENTION

Electrical conductors in the form of conductive foils are increasingly finding their way into many fields of engineering, for example automotive engineering. In addition to low production costs, the advantages of these foils are their flexibility and low overall height and a high electrical loading capacity. The latter is a consequence of the high surface/volume ratio, in comparison to electrical conductors with a round cross-section, resulting in improved cooling of the conductors. The high electrical loading capacity can be used for higher currents or for relatively smaller conductor cross-sections having the same current carrying capability.

Foils with a plurality of parallel conductor tracks correspond to conventional multi-core conductors. The interfaces with conventional conductors (for example cable harnesses) or with power consuming devices (for example electric motors or lighting fixtures) are a problem with foils as the conventional connecting techniques (for example soldering or welding) cannot be used. Therefore connectors are interposed, of which the contacts create a spring loaded connection to the conductor tracks of the foil and a connection to conventional current conductors.

EP 0 926 778 A2 discloses a connector for detachably connecting an electrically conductive foil to electrically conductive socket contacts of a socket housing, wherein the foil can be inserted into contact receiving apertures of spring contacts of the socket contacts and can be jammed therein. In the the socket contact there are resilient points of contact in its aperture. A certain mating force, with which the foil has to be inserted into the aperture, is required to overcome them. However, this requires considerably stiffness of the foil, so thin and flexible foils cannot be used in this connector.

An object of the invention is therefore to create an improved connector, a corresponding contact and an improved housing for detachably connecting a foil to a socket contact.

SUMMARY OF THE INVENTION

This and other objects are achieved with respect to the connector wherein housings are connected when the socket contact is open and connection proceeds virtually without any mating force. The foil slot in the foil housing serves, because of its long guide length, to guide the foil exactly and with low friction. Consequently, and because of the open contact receiving aperture during connection of the housings, very thin and flexible foils, which are particularly inexpensive, can also be used.

Closure of the contact receiving aperture, which is independent of the mating force-free connection of the housings, and jamming of the foil brought about thereby allows a high jamming force, ensuring good current conduction between foil and socket contact and secure locating of the foil in the connector.

It is advantageous that the foil housing comprises a foil housing front wall, a foil housing base wall, a foil housing top wall and two identical foil housing side walls, the walls forming the foil housing which is open at the end and into which the socket housing is insertable with play. This results in a stable foil housing which is an important precondition for mating force-free insertion of the socket housing into the foil housing.

An advantage of the invention is that the first foil slot is located in an outer foil receiving section and in a plurality of inner foil receiving sections arranged perpendicularly on the foil housing front wall and that the inner foil receiving sections each have a foil stop limiting the insertion depth of the foil. A long guide distance and a defined end position of the foil in the foil housing is thus achieved.

It is advantageous that a respective lever receiving opening for a lever shaft of a lever are provided in the foil housing side walls, and that the lever receiving openings have a bearing slot opening them in the direction of the foil housing top wall, the width of the slot being smaller than the diameter of the lever receiving opening. The width of the bearing slot is dimensioned such that, because of the elasticity of the plastics material of the foil housing, the lever shaft snaps with light pressure through the bearing slots into the lever receiving openings. The lever is thus captively connected to the foil housing.

As a result of the fact that the bearing slots have a funnel-shaped lead in surface toward the foil housing top wall, the lead in surface opening in a top wall opening of corresponding width, the lever shaft is guided to the lever receiving openings in a simple manner, and snaps therein.

For a stable socket housing and for exact guidance thereof in the foil housing it is advantageous that the socket housing has a socket housing front wall, a socket housing back wall, two identical socket housing side walls, a socket housing base wall and a socket housing top wall, the socket housing fitting into the foil housing with play.

It is also conceivable to configure the housings in such a way that the foil housing can be pushed into the socket housing and the pivoted shaft is mounted in the socket housing and the pivot lever can be locked to the foil housing.

For the stability of the socket contact inserted into the socket housing it is advantageous that partition plates with identical spacing are provided in the socket housing parallel to the socket housing side walls, between which plates the socket contacts can be inserted through back wall openings. When inserted through the back wall openings the socket contacts are guided and protected against deformation by the partition plates.

An advantageous development of the invention consists in that the second foil slot for inserting the foil is provided at the leading end of the socket housing in the socket housing front wall and front wall openings for inserting the inner foil receiving sections of the foil housing and indentations in the partition plates for enclosing and supporting the lever shaft are provided, the foil and the inner foil receiving sections being inserted and the lever shaft being enclosed when the housings are connected. When the housings are connected complementary components thus penetrate them, and this leads to multiple support of the foil and the lever shaft and therefore to their operational optimisation.

It is advantageous that the lever is pivotal between an open and a closed position, the lever, which is resilient, snapping into its closed position after overcoming at least one locking nose arranged on the socket housing, so the lever and the connected housings are locked.

Because of the locking according to the invention of the lever the connector cannot be loosened by vibration. This is important, above all, in the automotive sector. Instead of the two locking noses on the side walls of the socket housing just one can also be arranged in the centre of the back wall of the socket.

As a result of the fact that a number of cams corresponding to the number of socket contacts is non-rotatably arranged on the lever shaft, owing to which cams the foil is subjected to a predetermined normal contact force via the spring contacts of the socket contacts when the lever is locked, the foil is simultaneously jammed with locking of the connector. Insertion and jamming of the foil are thus clearly separated and optimised in each case.

It is also advantageous that the actuating force of the lever is determined as a function of its pivotal angle owing to the characteristic curve of the spring contacts and owing to the gradient of the contour of the cams. As the characteristic curve of the spring contacts of the socket contact and the gradient of the contour of the cam can vary within wide limits, the actuating force of the lever can be varied accordingly and designed as desired.

A gradient of the contour of the cam decreasing with increasing cam travel serves to limit the actuating force of the lever.

An important aspect of the invention consists in that the spring contacts comprise a first and a second spring region and the first spring region comprises a first and a second spring arm with free end faces arranged opposite one another with spacing. The spring contacts are designed in such a way that the desired progression of the characteristic curve of the spring and therefore a corresponding adjustment force of the lever is achieved by varying the dimensions of their components.

The shape according to the invention of the spring contacts provides the advantage of great variability in their design. Therefore the characteristic curve of the spring can be influenced by the length and width of the first spring region and of the spring arms and by the spacing of the opposing free end faces thereof.

Advantages also emerge from the fact that the socket contacts comprise the spring contacts, a securing section and a contact section, at least the securing section and the spring contacts being formed in one piece. The securing section brings about anchoring of the socket contact in the socket housing. The spring contacts provide the spring loaded connection of foil and socket contact. Their one-piece design with the securing section simplifies manufacture and reduces production costs. The contact section serves to connect the socket contact to other conductors, for example to conventional cables.

As a result of the fact that the contact receiving aperture is limited by the second spring region and the second spring arm, the foil comes into contact with electrically conductive elements from both sides. The electrically conductive parts of the foils must therefore be arranged on the upper or lower side thereof. In the unlocked state of the connector the contact receiving aperture is completely open and does not offer any resistance when the foil is inserted.

As the second spring region and the second spring arm comprise opposing protrusions, between which the foils are jammed when the connector is locked, the jamming force acts at certain points on the foil and consequently produces a high jamming pressure. This ensures good current conduction to the foil and adequate jamming thereof.

It is advantageous that the contact sections are designed as contact pins, contact clips or crimp contacts. The connector according to the invention can thus be connected to a wide variety of conductors. Examples include inter alia printed circuit boards to which the contact pins are soldered, or webs to which the contact clips are connected, or cables which are bonded to the crimp contact.

The fact that the securing sections are preferably designed in one piece with the contact pins and the contact clips and the crimp contacts are connected to other securing sections, preferably by laser welding, contributes to reducing the cost of the connector.

As the securing sections comprise barbs on their upper and lower edge, they can be anchored with interlocking fit in the socket housing. Loosening of the socket contacts is thus reliably prevented. This is important, above all, in automotive use.

BRIEF DESCRIPTION OF THE DRAWINGS

Further features of the invention can be found in the following description and the drawings in which embodiments of the invention are shown schematically, and in which.

DETAILED DESCRIPTION OF THE PREFERRED EMBODIMENT

Figure 1:
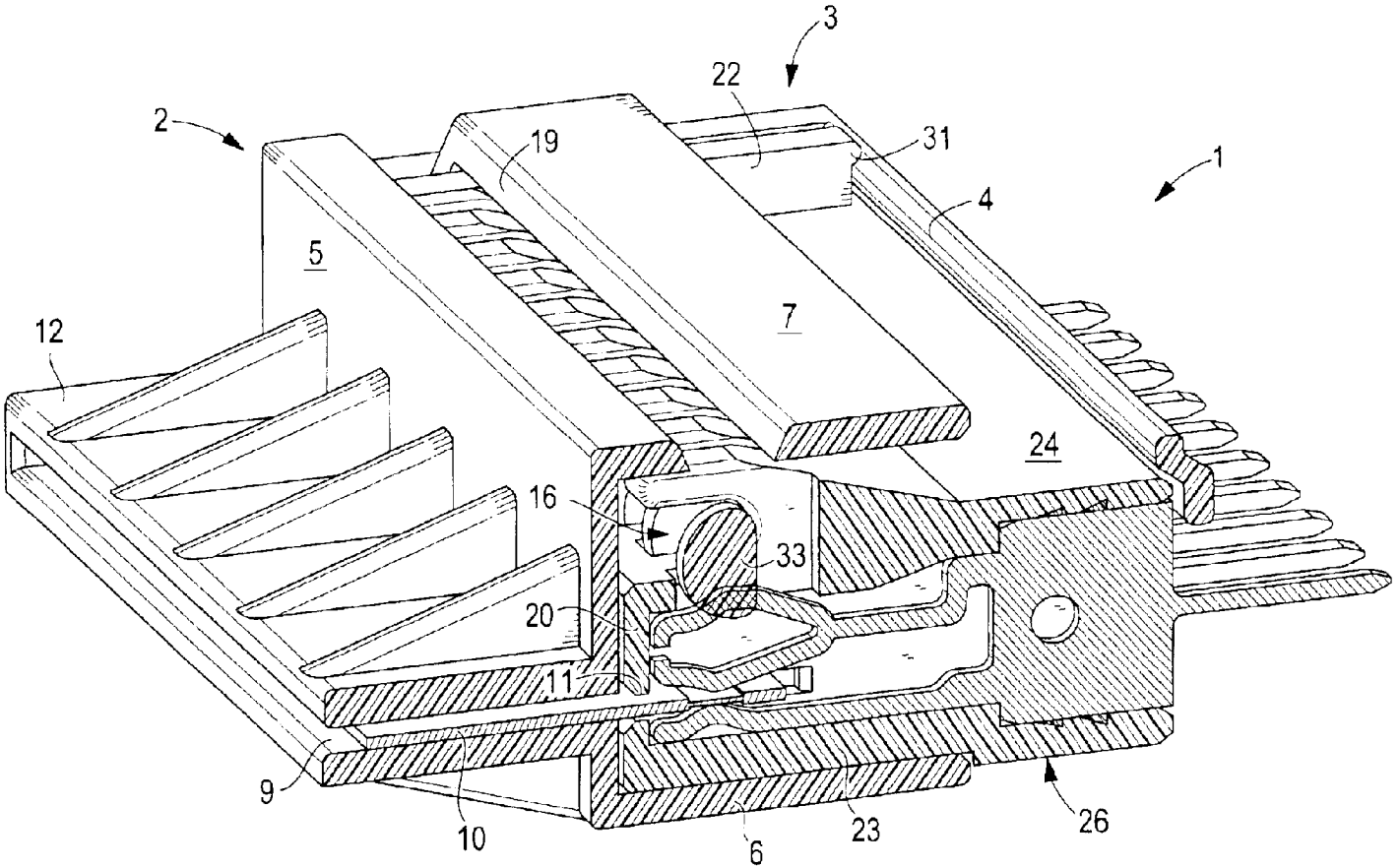
FIG. 1 is a perspective view of a cross-section through a closed and locked connector with a foil housing and a socket housing and a lever.

FIG. 1 shows a cross-section through a connector 1 according to the invention in a perspective view. The connector 1 is shown in the closed and locked state. It has a foil housing 2 and a socket housing 3 which are inserted in one another and locked by a lever 4.

The foil housing 2 has a foil housing front wall 5, a foil housing base wall 6, a foil housing top wall 7 and two foil housing side walls 8, which are not shown in FIG. 1. The walls 5, 6, 7, 8 form a foil housing 2 open at the back, into which the socket housing 3 can be inserted with play.

The foil housing 2 has a first foil slot 9 for introduction of a foil 10. The socket housing 3 has a second foil slot 11 aligning with the first foil slot 9 of the foil housing 2. Both foil slots 9, 11 have broken edges at their entry, facilitating introduction of the foil.

Figure 2:
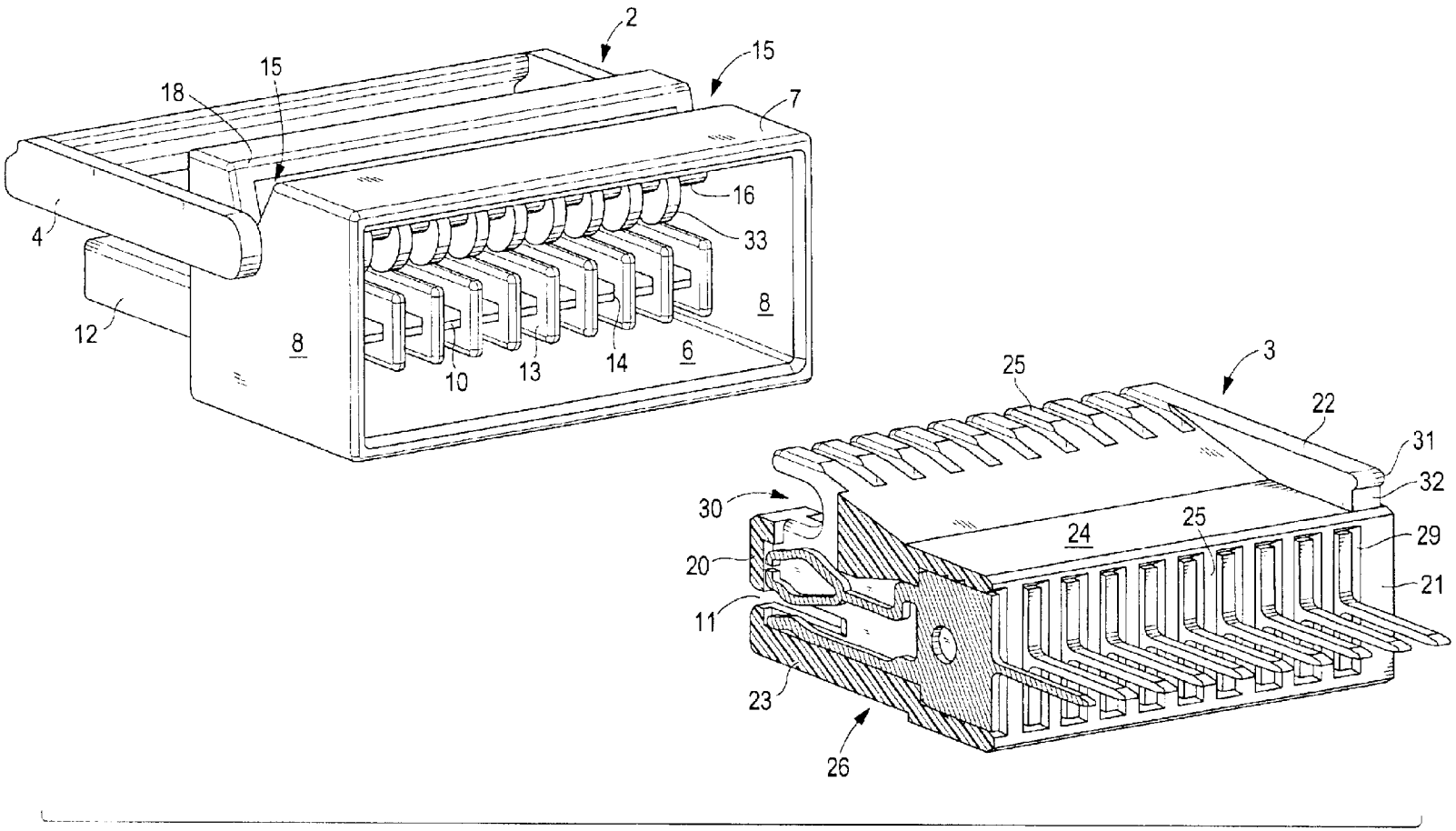
FIG. 2 is a perspective view of the connector in FIG. 1 in the open state.

The first foil slot 9 is located in an outer foil receiving section 12 and in inner foil receiving sections 13 arranged vertically on the front wall 5 of the foil housing 2. The inner foil receiving sections 13 are shown in FIG. 2. These comprise a foil stop 14 limiting the insertion depth of the foil 10.

There is preferably only a small amount of height play between the first foil slot 9 and the foil 10, resulting in good guidance thereof.

Figure 3:
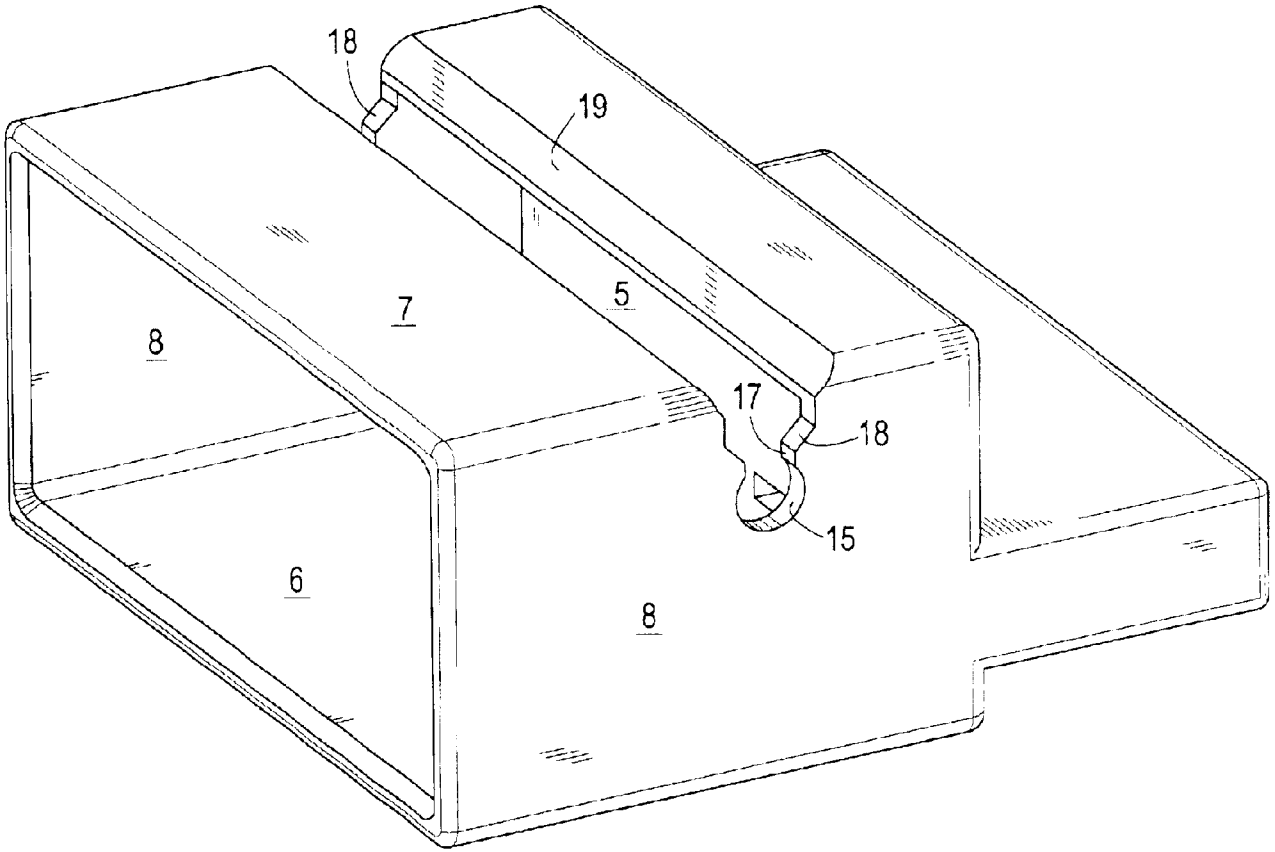
FIG. 3 is a perspective view of the foil housing in FIG. 2, but without lever.

A respective lever receiving opening 15, of which one is shown in FIG. 3, is arranged in the two side walls 8 of the foil housing 2. These serve as bearings for a lever shaft 16 of the lever 4. The lever receiving openings 15 are opened in the direction of the foil housing top wall 7 by a bearing slot 17, the width of the bearing slot 17 being smaller than the diameter of the lever receiving opening 15. The bearing slot 17 has a funnel-shaped lead in surface 18 ending in a top wall opening 19 of corresponding width.

In the assembly position a lever shaft 16 passes through the top wall opening 19 and the funnel-shaped lead in surface 18 above the bearing slot 17. With slight pressure on the lever shaft 16 the latter snaps into the lever receiving opening 15 while exploiting the elasticity of the plastics material of the foil housing 2. Consequently the lever 4 is captively connected to the foil housing 2.

The socket housing 3 has a socket housing front wall 20, a socket housing back wall 21, two identical socket housing side walls 22, a socket housing base wall 23 and a socket housing top wall 24. The walls 20, 21, 22, 23, 24 ensure the stability of the socket housing 3, so an optimum precondition for exact guidance in the foil housing is provided.

Partition plates 25 with identical spacing and forming narrow gaps for socket contacts 26, 27, 28, are provided in the socket housing 3 parallel to the socket housing side walls 22. Each of these gaps has a back wall opening 29 in the socket housing back wall 21, through which the respective socket contact 26, 27, 28 is inserted. During insertion and operation these socket contacts are guided and protected against deformation by the partition plates 25.

The second foil slot 11 for inserting the foil 10 and front wall openings (not shown) for inserting the inner foil receiving sections 13 of the foil housing 2, are provided on the leading end of the socket housing 3 in the socket housing front wall 20. In addition, indentations 30, serving to enclose and support the lever shaft 16 so the latter cannot bend under load, are arranged in the leading ends of the partition plates 25. The foil 10 and the inner foil receiving sections 13 are inserted and the lever shaft 16 enclosed virtually without mating force when the housings 2, 3 are connected.

The lever 4 is pivotal about approximately 180° between an open and a closed position. As it is resilient it can snap into its closed position after overcoming two locking noses 31. The locking noses 31 are provided at the upper, foil-remote corners of the socket housing side walls 22. A closing face 32 thereof is arranged somewhat set back with respect to the socket housing back wall 21. The locking force of the lever 4 presses thereon. The two housings 2, 3 are fixed owing to the lever 4 snapping into its closed position. In this state the socket housing front wall 20 is securely attached to the inner side of the foil housing front wall 5.

Figure 4:
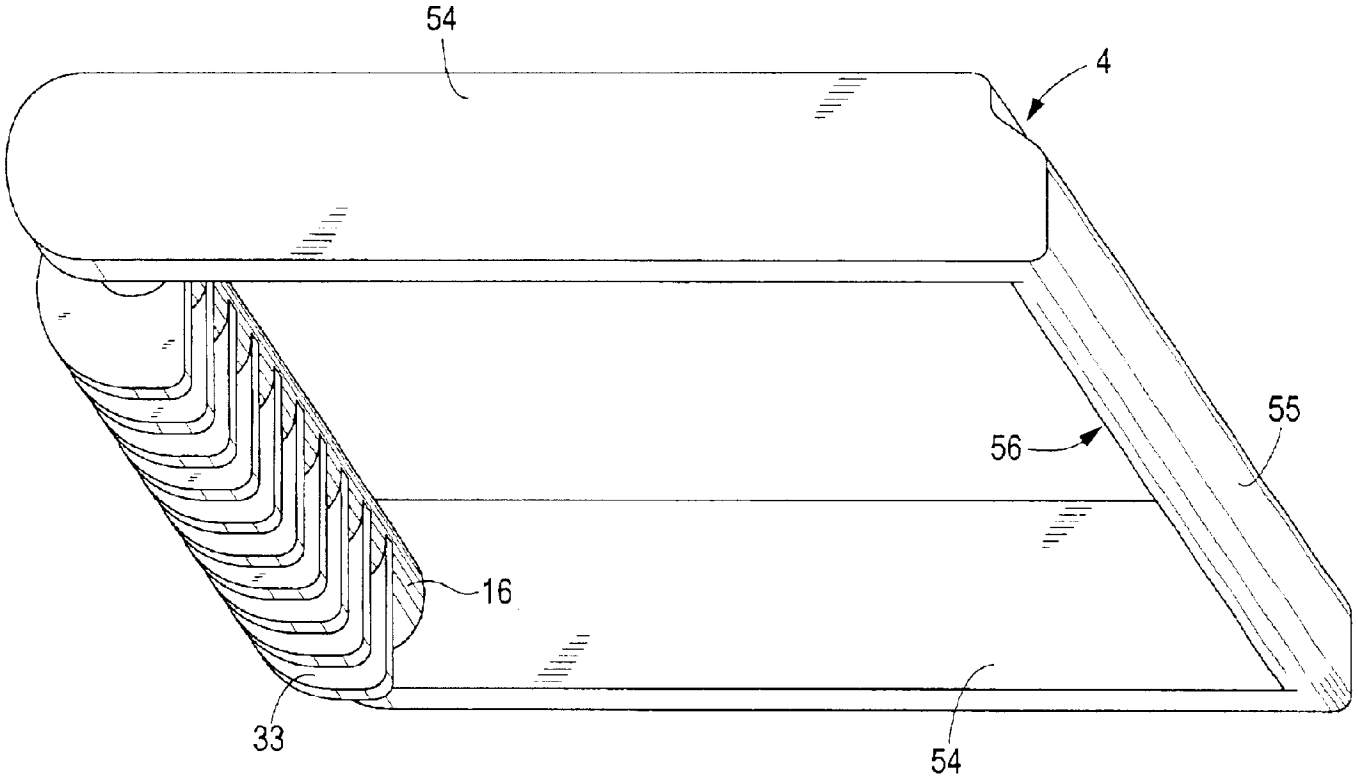
FIG. 4 is a perspective view of the lever.

Parallel, identically oriented cams 33 are non-rotatably arranged on the lever shaft 16, as can be seen in FIG. 4. The number and position of the cams 33 corresponds to the number and position of socket contacts 26, 27, 28. When the lever 4 is locked the foil 10 is subjected to a predetermined normal contact force owing to the cams 33 via socket pin contacts 26, as shown in FIGS. 1 and 5.

The actuating force of the lever 4 is dependent on the spring characteristic curve of the socket contacts 26, 27, 28 and on the gradient of the contour of the cams 33. As the gradient decreases with increasing cam travel, the actuating force of the lever 4 increases more slowly toward the closed position.

The lever 4 is a retaining element designed as a transverse rod in the form of a lever shaft 16 which is connected to a closed clevis. The clevis has two longitudinal arms 54 and a transverse arm 55 arranged opposite the transverse rod. On an inner face the transverse arm 55 has a retaining face 56 with which the socket housing 3 is retained on the foil housing 2. In the assembled state of the lever 4 the two longitudinal arms 54 are guided laterally along the foil housing 2. In a retaining position the longitudinal arms 45 project in front of the foil housing 2 and enclose the socket housing 3 inserted into the foil housing 2. In a simple embodiment only one longitudinal arm 54 is formed with a retaining face 56, instead of the rotatably mounted pivoted clevis 4.

Figure 5:
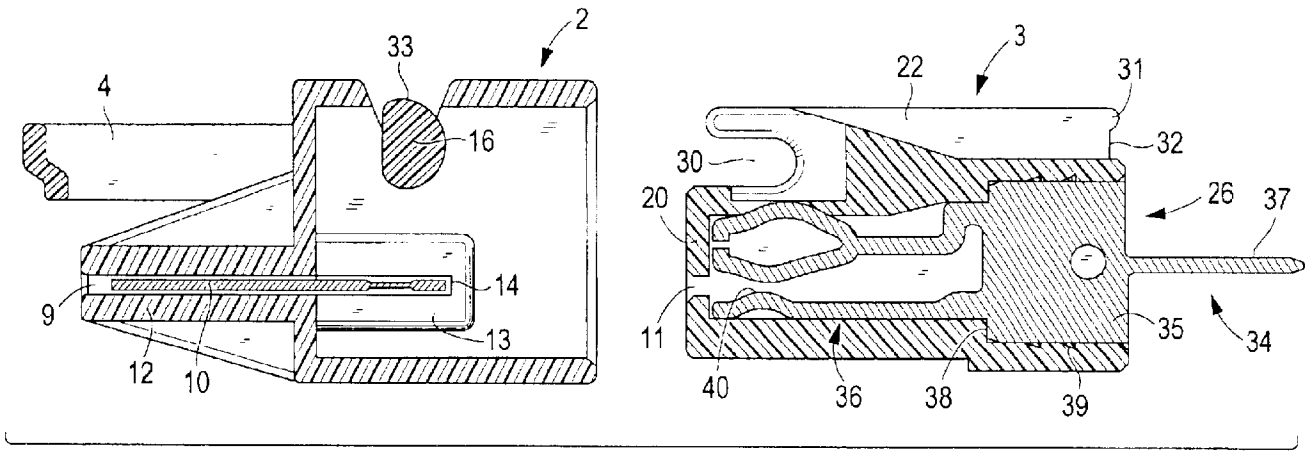
FIG. 5 is a plane cross-section through the open connector in FIG. 2.

The plane sectional view in FIG. 5 shows the connector 1 in the open state. The socket housing 3 opposes the foil housing 2 with spacing in the insertion position.

The tension lever 4 is snapped in the foil housing 2 and is in the open position with the cam 33. The foil 10 is inserted in the first foil slot 9 and rests against the foil stop 14.

There is a socket pin contact 26 in the socket housing 3. This consists of a spring contact 36, a securing section 35 and a contact section 34 designed as a contact pin 37.

The securing section 35 is inserted into the socket housing 3 up to a contact stop 38 and owing to its barbs 39, provided on an upper and a lower edge 52, 53 of the securing section 35, is anchored with interlocking fit therein.

The spring contact 36 has an open contact receiving aperture 40. The second foil slot 11 is located in front of it. The indentation 30 for supporting the lever shaft 16 is shown above the spring contact 36.

The connector 1 is closed by connecting the housings 2, 3. In the process the foil 10 passes through the second foil slot 11 into the open contact receiving aperture 40 and encloses the indentation 30, supporting the lever shaft 16. This takes place virtually without mating force.

Figure 6:
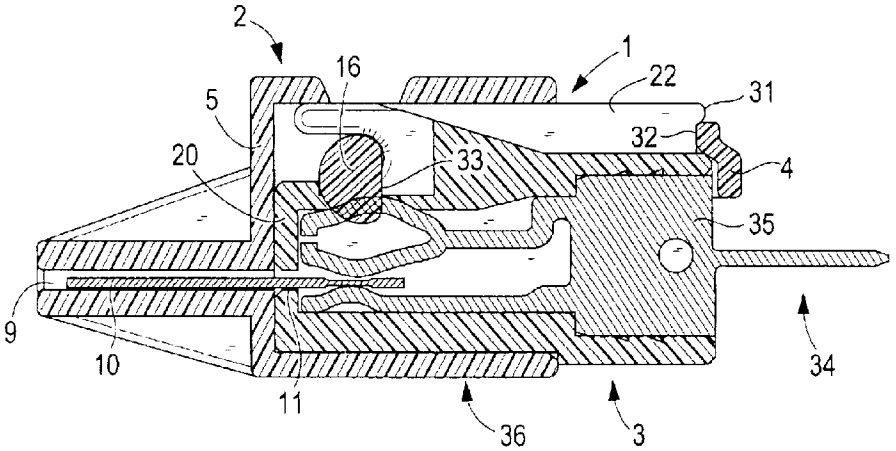
FIG. 6 is a plane cross-section through the closed connector in FIG. 1.

The connector 1 is locked by pivoting the lever 4 from its open position in FIG. 5 into its closed position in FIG. 6. In the process it resiliently overcomes the locking nose 31 and comes to rest on the closing face 32. At the same time the cam 13 reaches its maximum travel and loads the spring contact 36. As a result the contact receiving aperture 40 thereof is closed and the foil 10 inserted therein is jammed. The jamming region of the foil is stripped on both sides. Owing to the separate closing and locking of the connector 1 the former is carried out without mating force and the latter so as to be securely connected.

Figure 7:
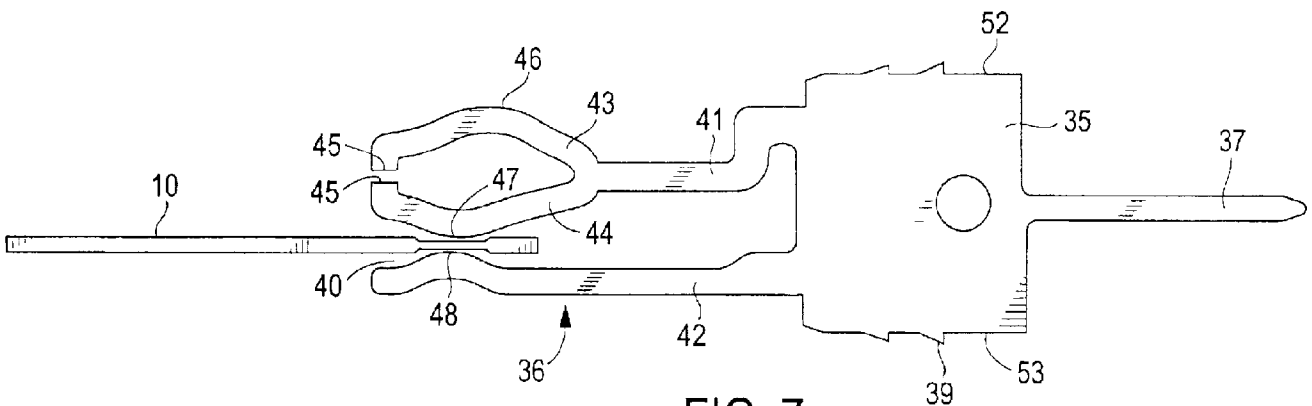
FIG. 7 is a side view of a socket contact with a contact pin.

FIG. 7 shows a socket pin contact 26 with a securing section 35, a spring contact 36 and a contact pin 37 which together consist of one piece.

The spring contact 36 consists of a first and a second spring region 41, 42. The first spring region 41 branches in a first and a second spring arm 43, 44. The spring arms 43, 44 have free end faces 45 arranged opposite one another with spacing.

The first spring arm 43 has a first protrusion 46 which can be loaded by the cam 33. The second spring arm 44 has a second protrusion 47 and the second spring region 42 a third protrusion 48 which are arranged opposite and facing one another and between which the stripped part of the foil 10 is jammed by the cam 33 via the first and second spring arm 43, 44 when the connector 1 is locked. A small jamming face for jamming the foil 10 is provided by the second and third protrusions 47, 48.

The small jamming face induces a high jamming pressure ensuring good current conduction between the spring contact 36 and the foil 10 and adequate jamming thereof.

The contact receiving aperture 40 is limited by the second spring region 42 and the second spring arm 44. As the spring contact 36 as a whole is current-carrying it is irrelevant whether the foil 10 is stripped in the jamming region on one side only or on both sides.

Figure 8:
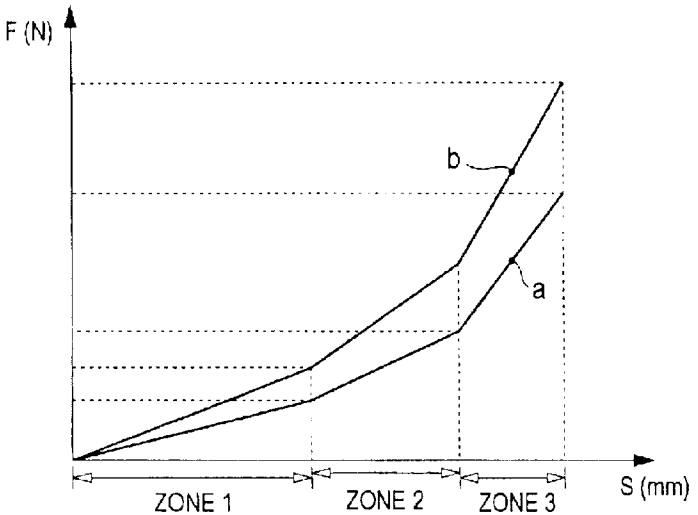
FIG. 8 is a graph of the actuating force of the lever and of the normal contact force over the travel of a spring contact.

FIG. 8 shows a graph in which the normal contact force a between the protrusions 47, 48 and the actuating force b of the lever 4 over the spring excursion s are shown.

The spring excursion s is divided into three zones. In zone 1 only the first spring region 41 and the first spring arm 43 operate and, more precisely, proceeding from 0 mm spring excursion to contact of the foil 10 by the second spring arm 44.

In zone 2 the first spring region 41 and the first and second spring regions 43, 44 operate until the free end faces 45 contact one another.

In zone 3 all three spring regions 41, 43, 44 operate, the spring arms 43, 44 acting as a unit and thus increasing the stiffness of the spring.

Owing to the change in length and width of the spring regions 41, 43, 44 and by changing the spacing of the free end faces 45, the normal contact force a and the actuating force b can be varied and optimised.

Figure 9:
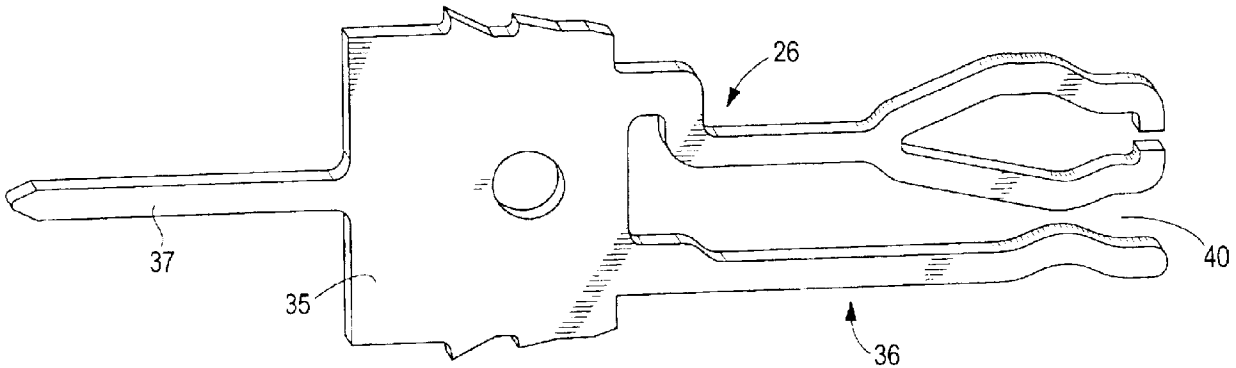
FIG. 9 is a perspective view of the socket pin contact in FIG. 7.

FIG. 9 shows a socket pin contact 26 in a perspective view, comprising the contact pin 37, the securing section 35, the contact spring 36 and the contact receiving aperture 40.

Figure 10:
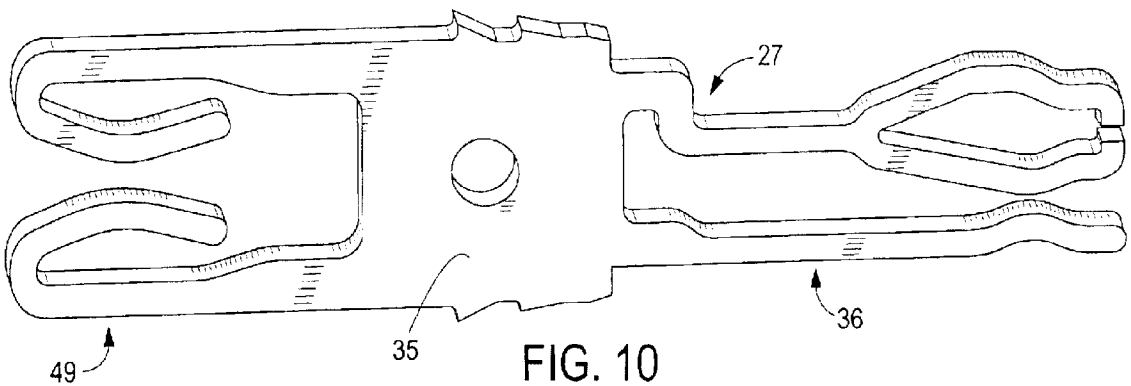
FIG. 10 is a perspective view of a socket clip contact with a contact clip.

FIG. 10 shows a socket clip contact in a perspective view. It differs from the socket pin contact 26 only in a contact clip 49 in place of the contact pin 37. While the contact pin 37 is suitable for soldering to a printed circuit board, the contact clip 49 is placed on a web.

Figure 11:
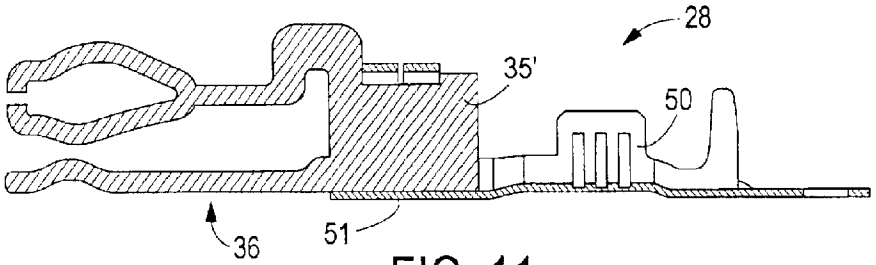
FIG. 11 is a longitudinal section through a socket crimp contact with a crimp contact.

FIG. 11 shows a longitudinal section through a socket crimp contact 28. This comprises the spring contact 36 which, with another securing section 35' forms a component. The other securing section 35' can be inserted into a plug-in housing 51 and can be connected thereto by laser welding.

The plug-in housing 51 is created by multiply folding a sheet metal board. It is formed as one piece with the crimp contact 50 which serves to connect a cable.

Figure 12:
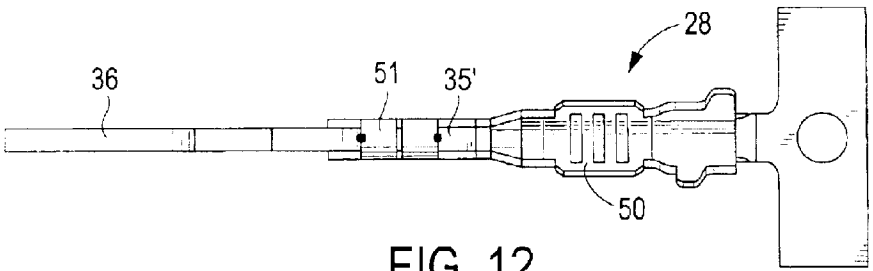
FIG. 12 is a plan view of the socket crimp contact in FIG. 11.

FIG. 12 shows a plan view of the socket crimp 28, comprising the spring contact 36, the other securing section 35', the plug-in housing 51 and the crimp contact 50. The position of the laser welding spots can be seen in FIG. 12.

Figure 13:
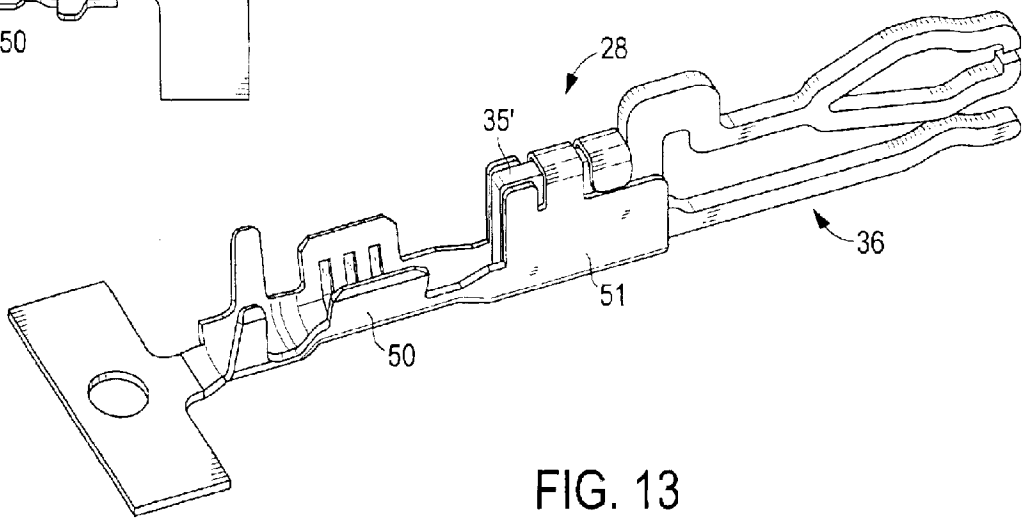
FIG. 13 is a perspective view of the socket crimp contact in FIG. 11.

FIG. 13 shows a perspective view of the socket crimp contact 28 clearly showing the assembled construction thereof.

The socket crimp contact 28 is anchored in the socket housing 3 by means of a slip hook, not shown.

Figure 14:
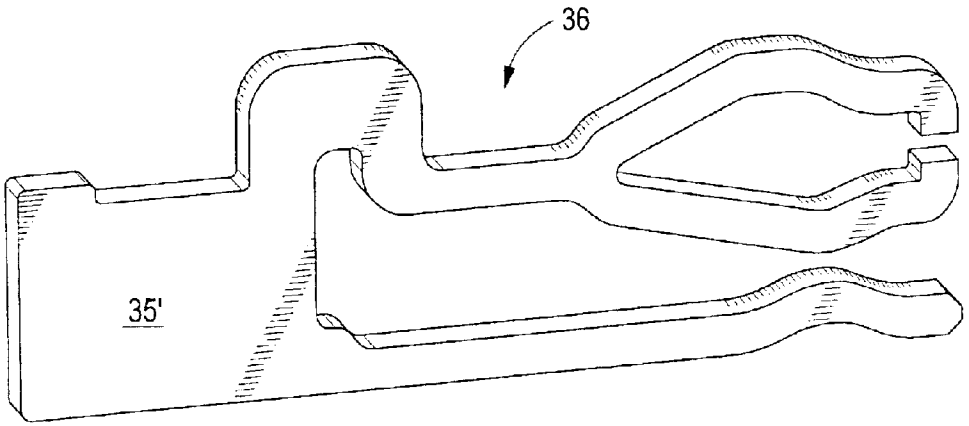
FIG. 14 is a perspective view of the spring contact of the socket crimp contact in FIG. 11.
Figure 15:
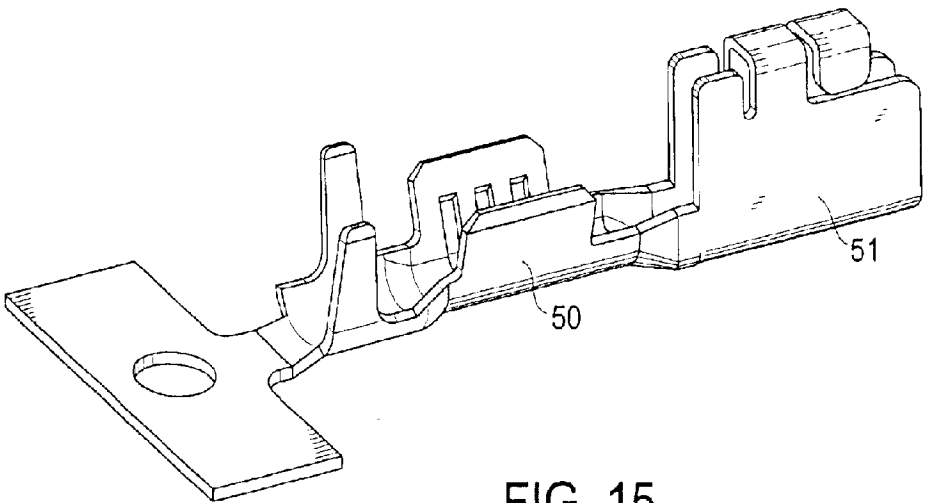
FIG. 15 is a perspective view of a plug-in part of the socket crimp contact in FIG. 11.

FIG. 14 is a perspective view of the other securing section 35' with the spring contact 36, while FIG. 15 is a perspective view of the plug-in housing 51 comprising the crimp contact 50, which are each designed in one piece.

The connector according to the invention functions as follows:

Firstly the lever 4 is snapped into the lever receiving openings 15 of the foil housing 2 in the open position. The foil 10 is then pushed into the first foil slot 9 up to the foil stop 14. The socket contacts 26 or 27 or 28 are then pushed into the socket housing 3 and then the socket housing 3 is pushed with minimal mating force into the foil housing 2. Finally, the lever 4 is pivoted from its open position into its closed position. Consequently the connector 1 is closed and locked, i.e. the housings 2, 3 are fixed and the foil 10 is jammed. A shakeproof, easily detachable connection to this foil is thus created.

The person skilled in the art can also mount the lever 4 in the socket housing 3, depending on the application. In this embodiment the associated foil housing 2 then has a corresponding locking nose 31 and closing face 32.

What is claimed is:

1. A connector for electrically connecting a conductive foil to socket contacts, the connector comprising:

a foil housing having a first foil slot for receiving the conductive foil;

a socket housing having a second foil slot aligned with the first foil slot; and socket contacts secured in the socket housing and being cooperable with the foil housing, the socket contacts having contact receiving apertures extending from spring contacts toward the second foil slot, the contact receiving apertures open upon insertion of the foil housing and being closed onto the conductive foil when the connector is locked to form an electrical connection between the conductive foil and the socket contacts.

2. The connector according to claim 1 wherein the socket contacts comprise the spring contact, a securing section for anchoring the socket contact in the socket housing and a contact section.

3. The connector according to claim 2, wherein the contact sections are formed as contact pins.

4. The connector according to claim 2, wherein the contact sections are formed as contact clips.

5. The connector according to claim 2, wherein the contact sections are formed as crimp contacts.

6. Connector according to claim 2, characterised in that the spring contacts have a first and a second spring region and the first spring region has a first and a second spring arm with free end faces arranged opposite one another with spacing therebetween.

7. The connector according to claim 6, wherein a characteristic curve of the spring contacts can preferably be influenced by the length and width of the first spring region and the spring arms and by the size of the spacing of the free end faces thereof.

8. The connector according to claim 6, wherein the contact receiving aperture is limited by the second spring region and the second spring arm.

9. The connector according to claim 6, further comprising a lever being pivotally mounted by a lever shaft to the foil housing and pivotable between an open position and a closed position, the lever latching in its closed position to lock the connected housings together, the lever shaft having cams arranged thereon to interact with the spring contacts such that the foil is subjected to a predetermined normal contact force when the lever is in the closed position, each cam corresponding to one of the socket contacts being arranged on the lever shaft, wherein the first spring arm has a first protrusion for contacting the cam.

10. The connector according to claim 6, wherein the second spring arm has a second protrusion and the second spring region has a third protrusion, the foil being jammed between the second and third protrusion when the connector is locked.

11. A connector for electrically connecting a conductive foil to socket contacts, the connector comprising:

a foil housing having a first foil slot for receiving the conductive foil;

a socket housing having a second foil slot aligned with the first foil slot and socket contacts secured in the socket housing and being cooperable with the foil housing, the socket contacts having contact receiving apertures extending from spring contacts toward the second foil slot, the contact receiving apertures being open upon insertion of the foil housing and being closed onto the conductive foil when the connector is locked to form an electrical connection between the conductive foil and the socket contacts; and a lever being pivotally mounted by a lever shaft to the foil housing.

12. The connector according to claim 11, wherein the lever is pivotable between open and a closed position.

13. The connector according to claim 12, wherein the lever latches in its closed position to lock the connected housings together.

14. The connector according to claim 13, further comprising cams each corresponding to one of the socket contacts being arranged on the lever shaft to interact with the spring contacts in such a way that the foil is subjected to a predetermined normal contact force when the lever is in the closed position.

15. A two part housing comprising:

a receiving region for an electrically conductive foil;

a spring contact having an open position and a closed position; and a retaining clement being rotatably mounted in the housing over the receiving region, the retaining element having an arm, that is pivotable into a connector region in front of the housing to a retaining position, the arm having a retaining face, which securely holds the two part housing together when in the retaining position, the retaining element being operable to move the spring contact from the open position to the closed position upon rotation into the securing position.

16. A housing according to claim 15, the retaining element has a transverse rod, the transverse rod is mounted in side walls of the housing and connected to a clevis, the clevis has longitudinal arms oriented laterally on the housing and a transverse arm connecting the longitudinal arms to one another, a retaining face positioned along the transverse arm.

* * * * *

UNITED STATES PATENT AND TRADEMARK OFFICE

CERTIFICATE OF CORRECTION

PATENT NO. : 6,854,995 B2
DATED : February 15, 2005
INVENTOR(S) : Gheorghe Hotea It is certified that error appears in the above-identified patent and that said Letters Patent is hereby corrected as shown below:

Column 8,
Line 30, "receiving apetures open" should read -- receiving apetures being open --.
Line 44, "Connector according to claim 2, characterised in that" should read -- The connector according to claim 2, wherein --.

Signed and Sealed this

Twenty-eighth Day of March, 2006

JON W. DUDAS
*Director of the United States Patent and Trademark Office*